US011320169B2

(12) United States Patent
Iida et al.

(10) Patent No.: US 11,320,169 B2
(45) Date of Patent: May 3, 2022

(54) CONTROLLER, RADIATIVE AIR-CONDITIONING EQUIPMENT, AND CONTROL METHOD

(71) Applicant: MITSUBISHI ELECTRIC CORPORATION, Tokyo (JP)

(72) Inventors: Takayoshi Iida, Tokyo (JP); Tomooki Ukiana, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/956,322

(22) PCT Filed: Dec. 26, 2017

(86) PCT No.: PCT/JP2017/046649

§ 371 (c)(1),
(2) Date: Jun. 19, 2020

(87) PCT Pub. No.: WO2019/130426

PCT Pub. Date: Jul. 4, 2019

(65) Prior Publication Data

US 2021/0080142 A1 Mar. 18, 2021

(51) Int. Cl.
*F24F 11/64* (2018.01)
*F24F 11/65* (2018.01)
(Continued)

(52) U.S. Cl.
CPC ..... *F24F 11/64* (2018.01); *F24F 11/65* (2018.01); *F24F 11/523* (2018.01); *F24F 11/54* (2018.01);
(Continued)

(58) Field of Classification Search
CPC ..... F24F 2110/10; F24F 11/30; F24F 11/46; F24F 11/64; F24F 11/65; F24F 11/523;
(Continued)

(56) References Cited

U.S. PATENT DOCUMENTS 5,216,887 A * 6/1993 Kadotani ..... A47G 5/00 165/49
5,729,994 A * 3/1998 Mukaiyama ..... F24F 5/0092 62/186
2020/0292214 A1* 9/2020 Bergman ..... F25B 23/003

FOREIGN PATENT DOCUMENTS

JP 58-179749 A 10/1983
JP 6-42780 A 2/1994
(Continued)

OTHER PUBLICATIONS

Performance analysis on system-level integration and operation of daytime radiative cooling technology for air-conditioning in buildings (Year: 2021).*
(Continued)

*Primary Examiner* — Darrin D Dunn
(74) *Attorney, Agent, or Firm* — Birch, Stewart, Kolasch & Birch, LLP

(57) ABSTRACT

A controller controls a radiative air-conditioning equipment which cools or heats space separated from indoor, space by a radiation panel, with an air conditioner, so as to cool or heat the indoor space by a radiation effect of the radiation panel. A data collection unit collects indoor environment data and panel temperature data from an indoor environment measurement sensor and a radiation panel measurement sensor, respectively. A heat quantity determination unit acquires panel characteristics data and device characteristics data, and determines a time-series pattern of a heat quantity to be processed by the radiative air-conditioning equipment based on the acquired data and the data collected by the data collection unit. An operation instruction unit gives to the air conditioner an instruction for operating the air conditioner according to the time-series pattern determined by the heat quantity determination unit.

16 Claims, 14 Drawing Sheets

(51) Int. Cl.

| | |
|---|---|
| *F24F 11/523* | (2018.01) |
| *F24F 110/20* | (2018.01) |
| *F24F 120/10* | (2018.01) |
| *F24F 110/10* | (2018.01) |
| *F24F 11/54* | (2018.01) |

(52) U.S. Cl.
CPC ..... *F24F 2110/10* (2018.01); *F24F 2110/20* (2018.01); *F24F 2120/10* (2018.01)

(58) Field of Classification Search
CPC .... F24F 2110/20; F24F 2120/10; F24F 11/54; F24F 2130/00; F24F 5/0089; F24F 11/62; F24F 1/00; F24F 5/00; F24F 11/52; G05B 15/02; G05B 2219/2614; Y02B 30/70
See application file for complete search history.

(56) References Cited

FOREIGN PATENT DOCUMENTS

| | | | |
|---|---|---|---|
| JP | 11-51447 | A | 2/1999 |
| JP | 2001-99458 | A | 4/2001 |
| JP | 2006-132823 | A | 5/2006 |
| JP | 2007-32933 | A | 2/2007 |
| JP | 2007-78332 | A | 3/2007 |
| JP | 2007-155206 | A | 6/2007 |
| JP | 2008-70093 | A | 3/2008 |
| JP | 2010-78181 | A | 4/2010 |
| JP | 2011-12933 | A | 1/2011 |
| JP | 2013-134037 | A | 7/2013 |
| JP | 2015-102270 | A | 6/2015 |
| JP | 2016-109407 | A | 6/2016 |
| WO | WO 2018/037471 | A1 | 3/2018 |

OTHER PUBLICATIONS

Sustainable cooling system for Kuwait hot climate combining diurnal radiative cooling and indirect evaporative cooling system (Year: 2020).*

Energy saving and economic analysis of a new hybrid radiative cooling system for single-family houses in the USA (Year: 2018).*

Potential energy savings by radiative cooling system for a building in tropical climate (Year: 2014).*

International Search Report (PCT/ISA/210) issued in PCT/JP2017/046649 dated Mar. 13, 2018.

* cited by examiner

CONTROLLER, RADIATIVE AIR-CONDITIONING EQUIPMENT, AND CONTROL METHOD

TECHNICAL FIELD

The present invention relates to a controller, a radiative air-conditioning equipment, a control method, and a control program.

BACKGROUND ART

Radiative air-conditioning equipment which cools/heats indoor space by a radiation effect of a radiation panel is advantageous in that it provides higher comfort than a convective air-conditioning equipment which cools/heats the indoor space by blowing out cool/hot air with a fan.

The radiative air-conditioning equipment comes in a water type and a pneumatic type. As described in Patent Literature 1, a pneumatic-type radiative air-conditioning equipment is advantageous when compared with a water-type radiative air-conditioning equipment, because a water pipe need not be installed on a radiation panel.

CITATION LIST

Patent Literature

Patent Literature 1: JP 2006-132823 A

SUMMARY OF INVENTION

Technical Problem

In a pneumatic-type air-conditioning equipment, an air conditioner cools/heats inside-ceiling space by blowing out cooling/heating air with a fan, so as to cool/heat a radiation panel, and cools/heats indoor space by a radiation effect of the radiation panel. Temperature of the radiation panel needs to be adjusted in accordance with target temperature of the indoor space. To what temperature the radiation panel should be adjusted differs depending on the equipment, as the characteristics of the radiation panel and air conditioner differ from one equipment to another.

In the prior art, the characteristics of the radiation panel and air conditioner are not taken into consideration, and accordingly the temperature of the radiation panel cannot be adjusted to an appropriate temperature with respect to the target temperature of the indoor space. Therefore, an operation of the radiative air-conditioning equipment may be inefficient undesirably.

An objective of the present invention is to operate a pneumatic-type radiative air-conditioning equipment efficiently.

Solution to Problem

A controller according to an aspect of the present invention, which is a controller for controlling a radiative air-conditioning equipment which cools or heats space separated from indoor space by a radiation panel, with an air conditioner, so as to cool or heat the indoor space by a radiation effect of the radiation panel, includes:

a data collection unit to collect indoor environment data indicating temperature of the indoor space, and panel temperature data indicating temperature of the radiation panel, from a sensor that measures temperature of the indoor space, and a sensor that measures temperature of the radiation panel, respectively;

a heat quantity determination unit to acquire panel characteristics data indicating characteristics of the radiation panel, and device characteristics data indicating characteristics of the air conditioner, and to determine a time-series pattern of a heat quantity to be processed by the air conditioner, based on the acquired data and the data collected by the data collection unit; and an operation instruction unit to give to the air conditioner an instruction for operating the air conditioner according to the time-series pattern determined by the heat quantity determination unit.

Advantageous Effects of Invention

In the present invention, a time-series pattern of a processing heat quantity is determined with taking into consideration the characteristics of the radiant panel and air conditioner provided to the pneumatic-type radiative air-conditioning equipment. Therefore, the pneumatic-type radiative air-conditioning equipment can be operated efficiently.

DESCRIPTION OF EMBODIMENTS

Figure 1:
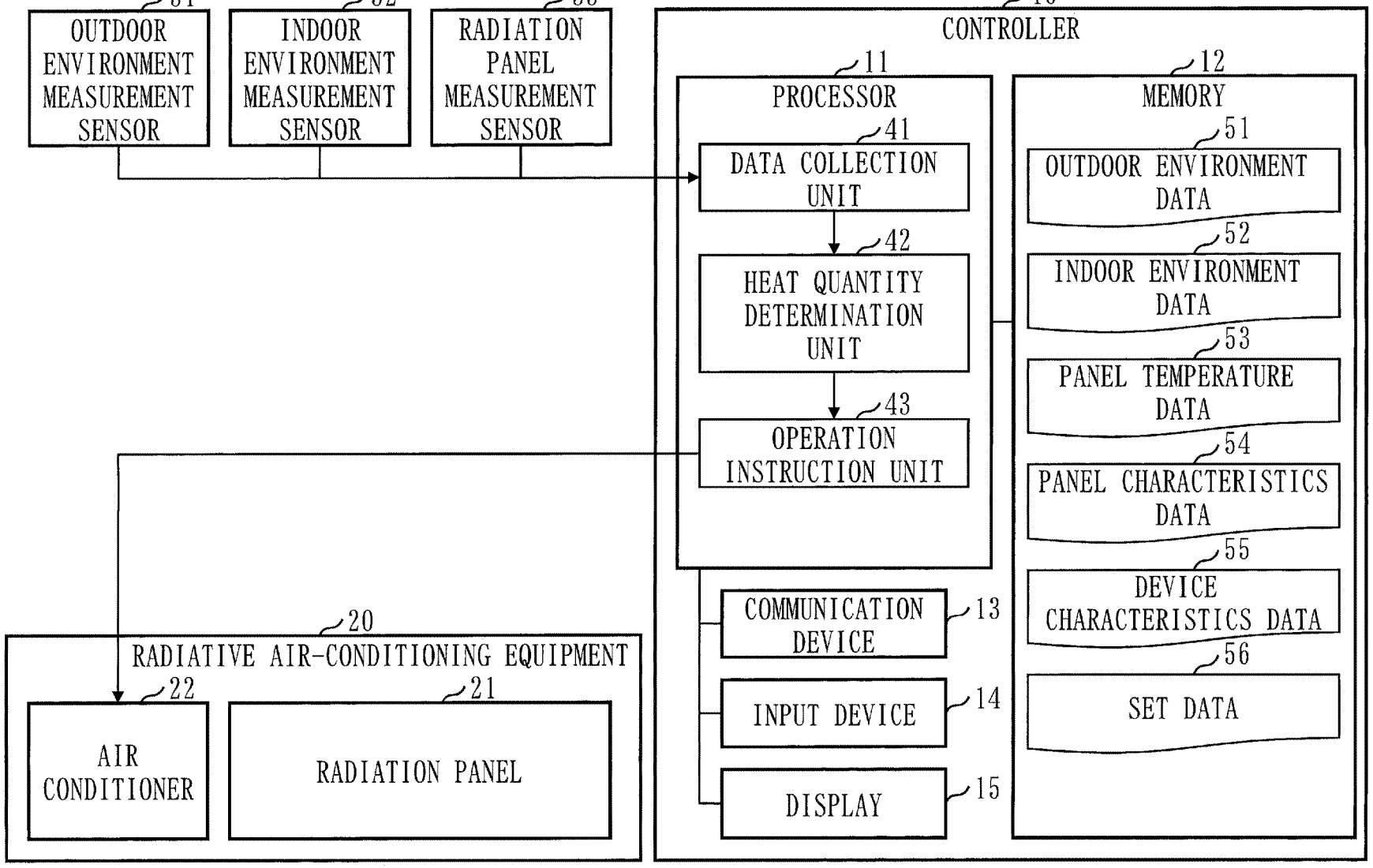
FIG. 1 is a block diagram illustrating a configuration of a controller according to Embodiment 1.

Embodiments of the present invention will be described with referring to drawings. In the drawings, the same or equivalent portions are denoted by the same reference numerals. In the description of the embodiments, explanation on the same or equivalent portions will be omitted or simplified appropriately. The present invention should not be construed as being limited to the embodiments described below, and various changes can be made to the present invention where necessary. For example, of the embodiments described below, two or more embodiments may be combined and practiced. Alternatively, of the embodiments described below, one embodiment or a combination of two or more embodiments may be practiced partially.

Embodiment 1

The present embodiment will be described with referring to FIGS. 1 and 2.

*Description of Configuration*

A configuration of a controller 10 according to the present embodiment will be described with referring to FIG. 1.

The controller 10 is a device that is connected to a pneumatic-type radiative air-conditioning equipment 20 by wired or wireless connection and controls the radiative air-conditioning equipment 20. In the present embodiment, the controller 10 is independent of the radiative air-conditioning equipment 20. Alternatively, the controller 10 may be mounted in the radiative air-conditioning equipment 20.

The radiative air-conditioning equipment 20 is provided with a radiation panel 21 and an air conditioner 22. The radiative air-conditioning equipment 20 cools or heats space separated from indoor space by the radiation panel 21, with the air conditioner 22, so as to cool or heat the indoor space by a radiation effect of the radiation panel 21. The space to be cooled or heated by the air conditioner 22 is, in the present embodiment, inside-ceiling space, but may be inside-wall space or under-floor space. The air conditioner 22 is, in the present embodiment, installed in the inside-ceiling space, but may be installed in another space and may supply cooled air or heated air to the inside-ceiling space via a duct.

The controller 10 is also connected to an outdoor environment measurement sensor 31, an indoor environment measurement sensor 32, and a radiation panel measurement sensor 33 by wired or wireless connection.

The outdoor environment measurement sensor 31 is a sensor that is installed outdoor to measure temperature of outer air. The indoor environment measurement sensor 32 is a sensor that is installed in indoor space to measure temperature of the indoor space. The radiation panel measurement sensor 33 is a sensor that is provided to or in the vicinity of the radiation panel 21, to measure temperature of the radiation panel 21.

The controller 10 is a computer. The controller 10 is provided with a processor 11 as well as other hardware devices such as a memory 12, a communication device 13, an input device 14, and a display 15. The processor 11 is connected to the other hardware devices via a signal line and controls the other hardware devices.

The controller 10 is provided with a data collection unit 41, a heat quantity determination unit 42, and an operation instruction unit 43, as function elements. Functions of the data collection unit 41, heat quantity determination unit 42, and operation instruction unit 43 are implemented by software.

The processor 11 is a device that executes a control program. The control program is a program that implements the functions of the data collection unit 41, heat quantity determination unit 42, and operation instruction unit 43. The processor 11 is, for example, a CPU. Note that "CPU" stands for central processing unit.

The memory 12 is a device that stores the control program. The memory 12 is, for example, a RAM or a flash memory, or a combination of them. Note that "RAM" stands for random access memory.

Outdoor environment data 51, indoor environment data 52, panel temperature data 53, panel characteristics data 54, device characteristics data 55, and set data 56, which are to be described later, are stored in the memory 12.

The communication device 13 involves a receiver to receive data inputted to the control program and a transmitter to transmit data outputted from the control program. The communication device 13 is, for example, a communication chip or an NIC. Note that "NIC" stands for network interface card.

The input device 14 is a device operated by a user to input data to the control program. The input device 14 is, for example, a mouse, a keyboard, or a touch panel, or a combination of some or all of them.

The display 15 is a device that displays, on a screen, data outputted from the control program. The display 15 is, for example, an LCD. Note that "LCD" stands for liquid crystal display.

The control program is read from the memory 12 by the processor 11 and executed by the processor 11. Not only the control program but also an OS is stored in the memory 12. Note that "OS" stands for operating system. The processor 11 executes the control program while executing the OS. The control program may be incorporated in the OS partially or entirely.

The control program and the OS may be stored in an auxiliary storage device.

The auxiliary storage program is, for example, an HDD or a flash memory, or a combination of them. Note that "HDD" stands for hard disk drive. If the control program and the OS are stored in the auxiliary storage device, they are loaded to the memory 12 and executed by the processor 11.

The controller 10 may be provided with a plurality of processors which substitute for the processor 11. The plurality of processors share execution of the control program. Each processor is, for example, a CPU.

Data, information, a signal value, and a variable value which are utilized, processed, or outputted by the control program are stored in the memory 12, the auxiliary storage device, or a register or cache memory in the processor 11.

The control program is a program that causes the computer to execute a process performed by the data collection unit 41, a process performed by the heat quantity determination unit 42, and a process performed by the operation instruction unit 43, as a data collection process, a heat quantity determination process, and an operation instruction process, respectively. The control program may be recorded in a computer-readable medium and provided in the form of the medium, may be stored in a recording medium and provided in the form of the recording medium, or may be provided as a program product.

The controller 10 may be configured by one computer or a plurality of computers. When the controller 10 is configured by a plurality of computers, the functions of the data collection unit 41, heat quantity determination unit 42, and operation instruction unit 43 may be distributed among the individual computers and implemented by the individual computers.

*Description of Behavior*

Behavior of the controller 10 according to the present embodiment will be described with referring to FIG. 2. The behavior of the controller 10 corresponds to a control method according to the present embodiment.

In step S101, the data collection unit 41 collects the outdoor environment data 51, the indoor environment data 52, and the panel temperature data 53 from the outdoor environment measurement sensor 31, the indoor environment measurement sensor 32, and the radiation panel measurement sensor 33, respectively. The outdoor environment data 51 is data indicating temperature of outer air. The indoor environment data 52 is data indicating temperature of indoor space. The panel temperature data 53 is data indicating temperature of the radiation panel 21.

Specifically, in step S101, the data collection unit 41 receives the outdoor environment data 51, the indoor environment data 52, and the panel temperature data 53 from the outdoor environment measurement sensor 31, the indoor environment measurement sensor 32, and the radiation panel measurement sensor 33, respectively, using the communication device 13. The data collection unit 41 writes the received data into the memory 12.

In step S102 to step S104, the heat quantity determination unit 42 acquires the panel characteristics data 54 and the device characteristics data 55. The panel characteristics data 54 is data indicating characteristics of the radiation panel 21. The panel characteristics data 54 includes data indicating characteristics of an opening which is formed in the radiation panel 21 for supplying air to the indoor space from space cooled or heated by the air conditioner 22. The data indicating the characteristics of the opening is, in the present embodiment, data indicating an opening area of the opening. The panel characteristics data 54 also includes data indicating an area of a radiation surface of the radiation panel 21. The panel characteristics data 54 also includes data indicating emissivity of the radiation panel 21. The device characteristics data 55 is data indicating characteristics of the air conditioner 22. The device characteristics data 55 includes data indicating characteristics of at least any one of the compressor, heat exchanger, and fan of the air conditioner 22. Data indicating characteristics of the fan includes data indicating efficiency of a fan motor. The heat quantity determination unit 42 determines a time-series pattern 57 of a heat quantity to be processed by the radiative air-conditioning equipment 20, based on the acquired data and the data which is collected by the data collection unit 41.

Specifically, in step S102, the heat quantity determination unit 42 reads the indoor environment data 52, panel characteristics data 54, and set data 56 from the memory 12. The indoor environment data 52 is written in the memory 12 in step S101. Assume that the panel characteristics data 54 and the set data 56 are stored in the memory 12 before step S101. The set data 56 is data indicating various kinds of setting. The set data 56 includes data indicating target temperature of the indoor space. The heat quantity determination unit 42 determines the target temperature of the radiation panel 21 in accordance with the target temperature indicated by the set data 56, the temperature indicated by the indoor environment data 52, and the characteristics indicated by the panel characteristics data 54.

A user may set the target temperature of the indoor space. In this case, the data collection unit 41 accepts setting of the target temperature via the input device 14. The data collection unit 41 writes data indicating the set target temperature to the memory 12 as part of the set data 56. This data is read by the heat quantity determination unit 42 in step S102.

Although not indispensible, in step S102, ventilation of the indoor air may be considered. In this case, the heat quantity determination unit 42 further reads the outdoor environment data 51 from the memory 12. The heat quantity determination unit 42 determines the target temperature of the radiation panel 21 in accordance with the target temperature indicated by the set data 56, the temperature indicated by the indoor environment data 52, the temperature indicated by the outdoor environment data 51, and the characteristics indicated by the panel characteristics data 54.

In step S103 and step S104, the heat quantity determination unit 42 reads the panel temperature data 53 and device characteristics data 55 from the memory 12. The panel temperature data 53 is written in the memory 12 in step S101. Assume that the device characteristics data 55 is stored in the memory 12 before step S101. The heat quantity determination unit 42 determines the time-series pattern 57 in accordance with the target temperature determined in step S102, the temperature indicated by the panel temperature data 53, and the characteristics indicated by the device characteristics data 55.

More specifically, in step S103, the heat quantity determination unit 42 compares the target temperature determined in step S102 with the temperature indicated by the panel temperature data 53. That is, the heat quantity determination unit 42 compares the target temperature and the present temperature of the radiation panel 21. If the target temperature and the present temperature of the radiation panel 21 do not coincide, a process of step S104 is performed. If the target temperature and the present temperature of the radiation panel 21 coincide, a process of step S106 is performed.

In step S104, the heat quantity determination unit 42 calculates a sum of the heat quantity to be processed by the air conditioner 22 based on a difference between the target temperature of the radiation panel 21 and the temperature indicated by the panel temperature data 53. This sum reflects the characteristics of the radiation panel 21, because the target temperature of the radiation panel 21 is determined in step S102 with taking the characteristics of the radiation panel 21 into consideration. The heat quantity determination unit 42 sets a plurality of candidates for the time-series pattern 57 to match the calculated sum. For each set candidate, the heat quantity determination unit 42 calculates a coefficient of performance corresponding to the characteristics indicated by the device characteristics data 55. The heat quantity determination unit 42 chooses one candidate based on the calculated coefficient of performance, thereby determining the time-series pattern 57.

In the present embodiment, the set data 56 also includes a target time within which the temperature of the indoor space should reach the target temperature of the indoor space. The heat quantity determination unit 42 determines the time-series pattern 57 in accordance with the target time indicated by the set data 56, the target temperature of the radiation panel 21, the temperature indicated by the panel temperature data 53, and the characteristics indicated by the device characteristics data 55.

Figure 2:
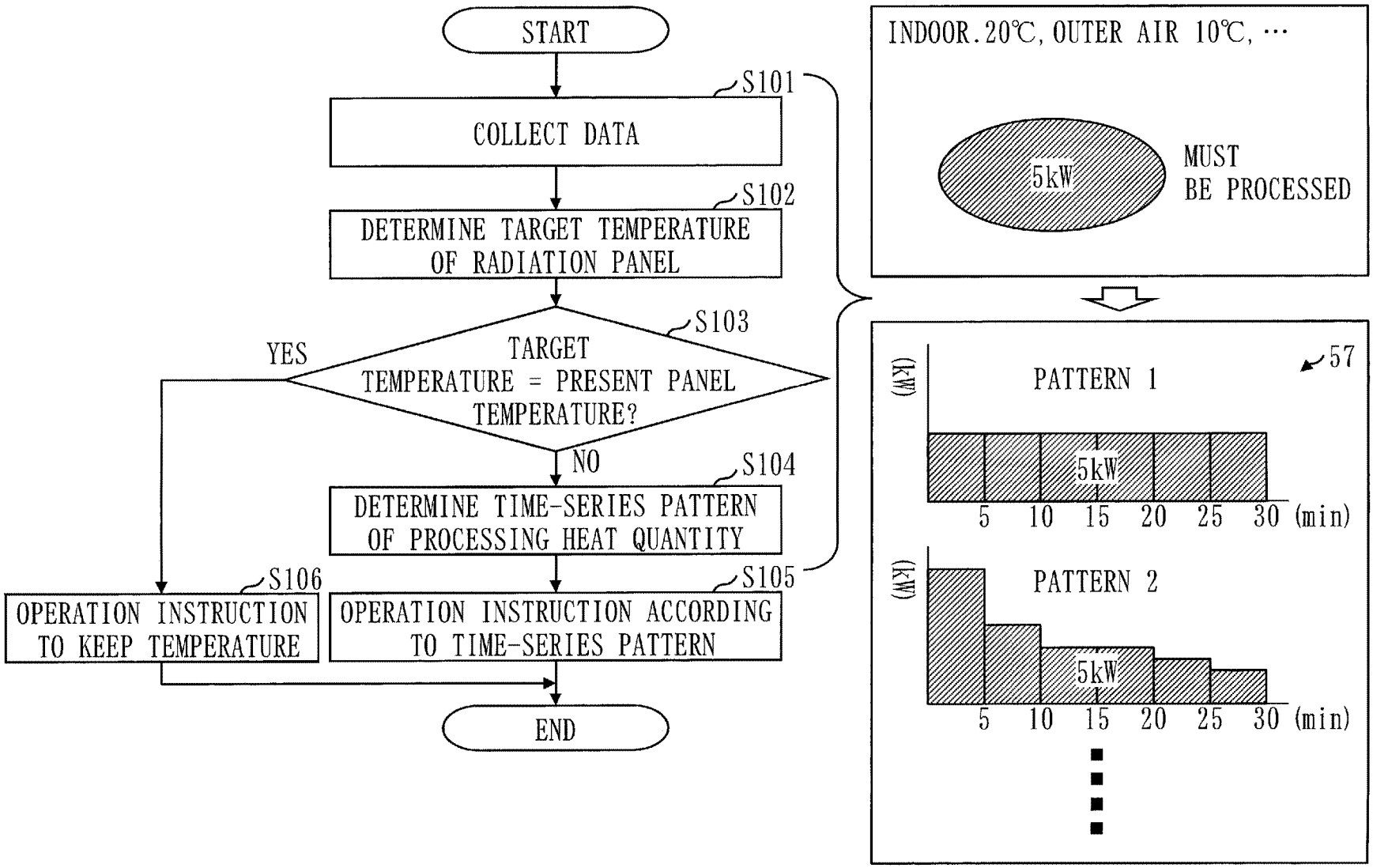
FIG. 2 is a flowchart illustrating behavior of the controller according to Embodiment 1.

In the example illustrated in FIG. 2, the sum of the heat quantity to be processed by the air conditioner 22 is 5 kW, and the target time within which the temperature of the indoor space should reach the target temperature of the indoor space is 30 minutes. Hence, both of the candidates such as pattern 1 and pattern 2 for the time-series pattern 57 are set to be able to process a heat quantity of 5 kW within 30 minutes. In this example, a processing heat quantity is set every 5 minutes. The set time unit is not limited to 5 minutes and any time unit such as 3 minutes and 10 minutes may be employed.

The heat quantity determination unit 42 may set not only the processing heat quantity per unit time but also a wind direction and air volume of the air conditioner 22 per unit time. In a specific example, pattern 1 can be set as a pattern in which the wind direction and the air volume are constant, and pattern 2 can be set as a pattern to first blow out a downward strong wind and then blow out an upward weak wind.

When anticipating condensation of the radiation panel 21 from the temperature and humidity of the radiation panel 21 and determining the time-series pattern 57, the heat quantity determination unit 42 may take an anticipation result of condensation into consideration.

The user may set the target time within which the temperature of the indoor space should reach the target temperature of the indoor space. In this case, the data collection unit 41 accepts setting of the target time via the input device 14. The data collection unit 41 writes data indicating the set target time into the memory 12 as part of the set data 56. In step S102, this data is read by the heat quantity determination unit 42.

In step S105, the operation instruction unit 43 supplies to the air conditioner 22 an instruction for operating the air conditioner 22 according to the time-series pattern 57 determined by the heat quantity determination unit 42.

Specifically, in step S105, the operation instruction unit 43 transmits to the air conditioner 22, using the communication device 13, a signal instructing an operation that matches the processing heat quantity per unit time of the time-series pattern 57 determined by the heat quantity determination unit 42.

In step S106, the operation instruction unit 43 supplies to the air conditioner 22 an instruction for keeping the temperature of the radiation panel 21 by the air conditioner 22.

Specifically, in step S106, the operation instruction unit 43 transmits to the air conditioner 22, using the communication device 13, a signal instructing to keep the temperature of the radiation panel 21.

When condensation of the radiation panel 21 is detected, the operation instruction unit 43 may urgently give an instruction for avoiding condensation to the air conditioner 22.

Description of Effect of Embodiment

In the present embodiment, the time-series pattern 57 of the processing heat quantity is determined with taking into consideration the characteristics of the radiation panel 21 and air conditioner 22 provided to the pneumatic-type radiative air-conditioning equipment 20. Therefore, the pneumatic-type radiative air-conditioning equipment 20 can be operated efficiently.

In the present embodiment, the data collection unit 41 collects the data on the indoor environment such as indoor temperature, data on the outdoor environment such as outer air temperature, and data on the radiation panel 21 such as panel temperature. The heat quantity determination unit 42 calculates a heat quantity to be processed based on data of an indoor environment and outdoor environment, while taking into consideration the characteristics of the radiation panel 21 such as emissivity, a panel area, and an opening area. The heat quantity determination unit 42 makes up a plan for a processing heat quantity which matches the calculated heat quantity and with which energy conservation can be achieved, while taking into consideration the characteristics of the air conditioner 22 such as compressor characteristics, heat exchanger characteristics, and fan motor efficiency. According to the plan, the operation instruction unit 43 supplies an appropriate instruction to the air conditioner 22.

Hence, in the pneumatic-type radiative air-conditioning equipment 20 which utilizes a heat pump, control with high energy conservation effect is possible in view of a target processing heat quantity, by taking into consideration the device characteristics and the radiation effect. That is, it is possible to satisfy both energy conservation and comfort while taking into consideration the device characteristics of the radiative air-conditioning equipment 20 which is for use in a building and so on, and radiation panel temperature transmission via air.

*Other Configurations*

In the present embodiment, the functions of the data collection unit 41, heat quantity determination unit 42, and operation instruction unit 43 are implemented by software. In a modification, the functions of the data collection unit 41, heat quantity determination unit 42, and operation instruction unit 43 may be implemented by hardware. This modification will be described mainly regarding its difference from the present embodiment.

Figure 3:
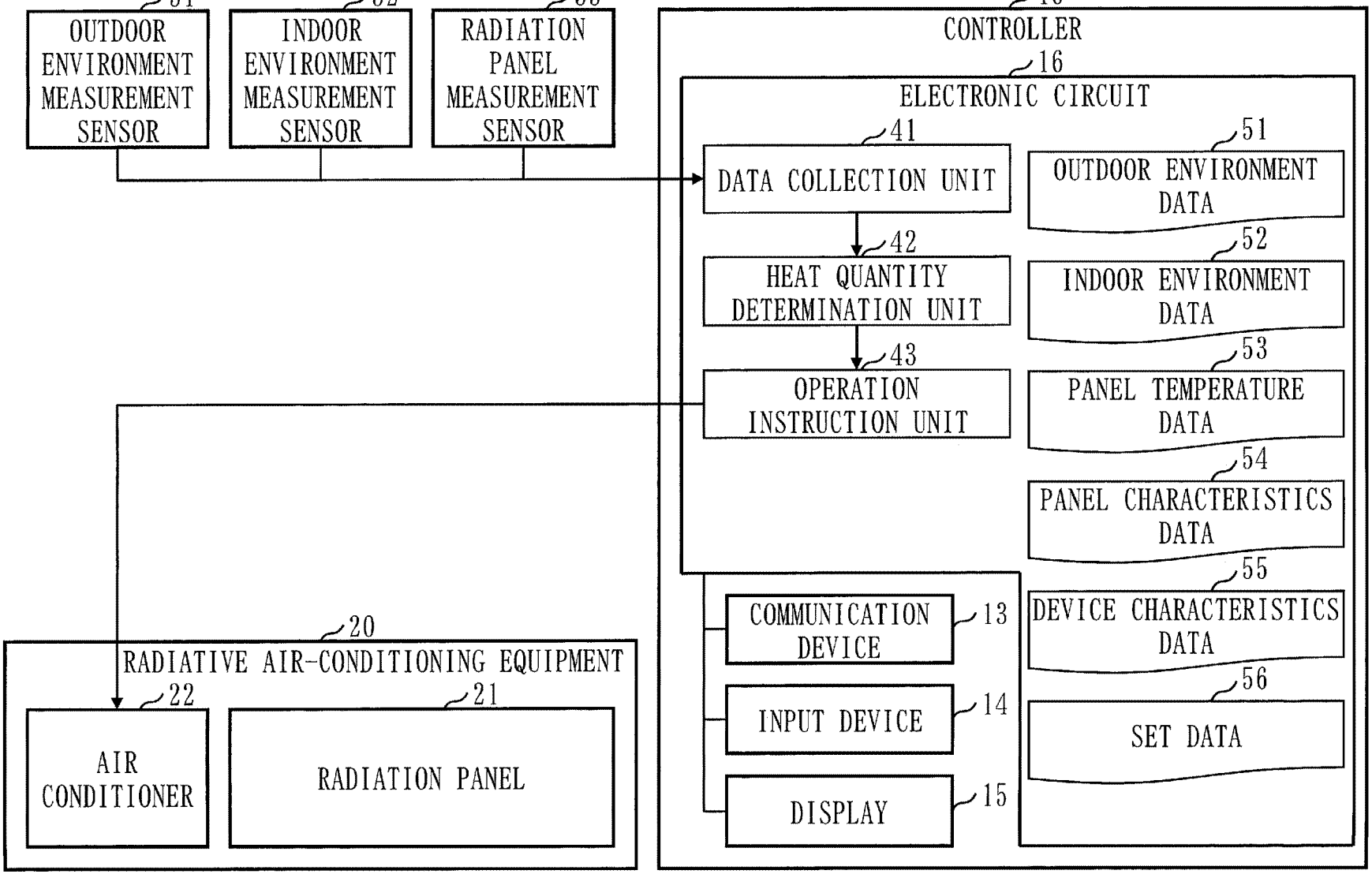
FIG. 3 is a block diagram illustrating a configuration of a controller according to a modification of Embodiment 1.

A configuration of a controller 10 according to the modification of the present embodiment will be described with referring to FIG. 3.

The controller 10 is provided with hardware devices such as an electronic circuit 16, an input device 14, a display 15, and a communication device 13.

The electronic circuit 16 is dedicated hardware that implements functions of a data collection unit 41, heat quantity determination unit 42, and operation instruction unit 43. The electronic circuit 16 is, for example, a single circuit, a composite circuit, a programmed processor, a parallel-programmed processor, a logic IC, a GA, an FPGA, or an ASIC; or a combination of some or all of them. Note that "IC" stands for integrated circuit, "GA" for gate array, "FPGA" for field-programmable gate array, and "ASIC" for application specific integrated circuit.

The controller 10 may be provided with a plurality of electronic circuits that substitute for the electronic circuit 16. The plurality of electronic circuits altogether implement the functions of the data collection unit 41, heat quantity determination unit 42, and operation instruction unit 43. Each electronic circuit is, for example, a single circuit, a composite circuit, a programmed processor, a parallel-programmed processor, a logic IC, a GA, an FPGA, or an ASIC; or a combination of some or all of them.

According to another modification, the functions of the data collection unit 41, heat quantity determination unit 42, and operation instruction unit 43 may be implemented by a combination of software and hardware. That is, some of the functions of the data collection unit 41, heat quantity determination unit 42, and operation instruction unit 43 may be implemented by dedicated hardware, and the remaining functions may be implemented by software.

A processor 11 and individual electronic circuit 16 are processing circuitry. That is, regardless of whether the configuration of the controller 10 is the configuration illustrated in FIG. 1 or FIG. 3, behaviors of the data collection unit 41, heat quantity determination unit 42, and operation instruction unit 43 are performed by the processing circuitry.

Embodiment 2

Figure 4:
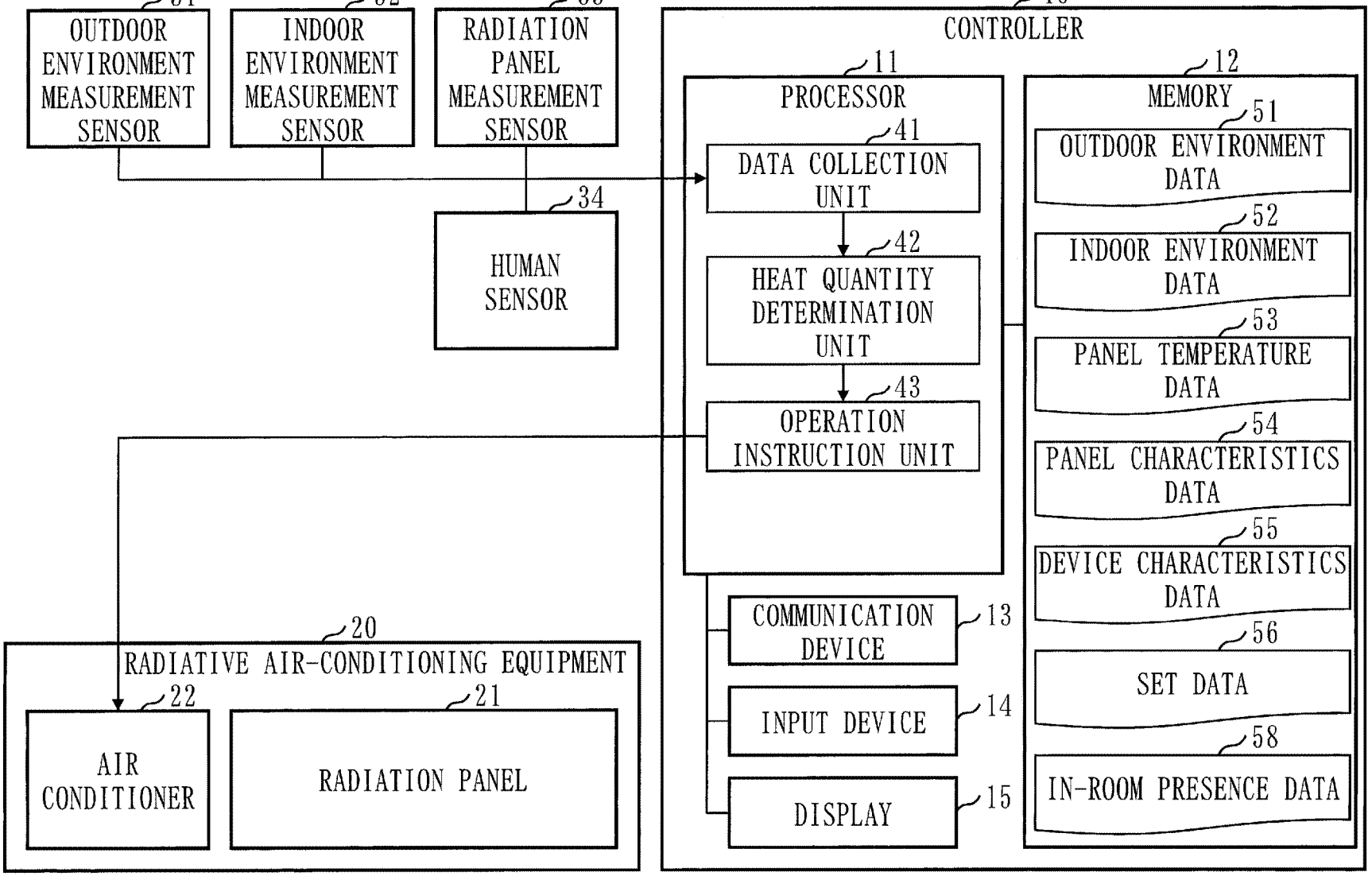
FIG. 4 is a block diagram illustrating a configuration of a controller according to Embodiment 2.
Figure 5:
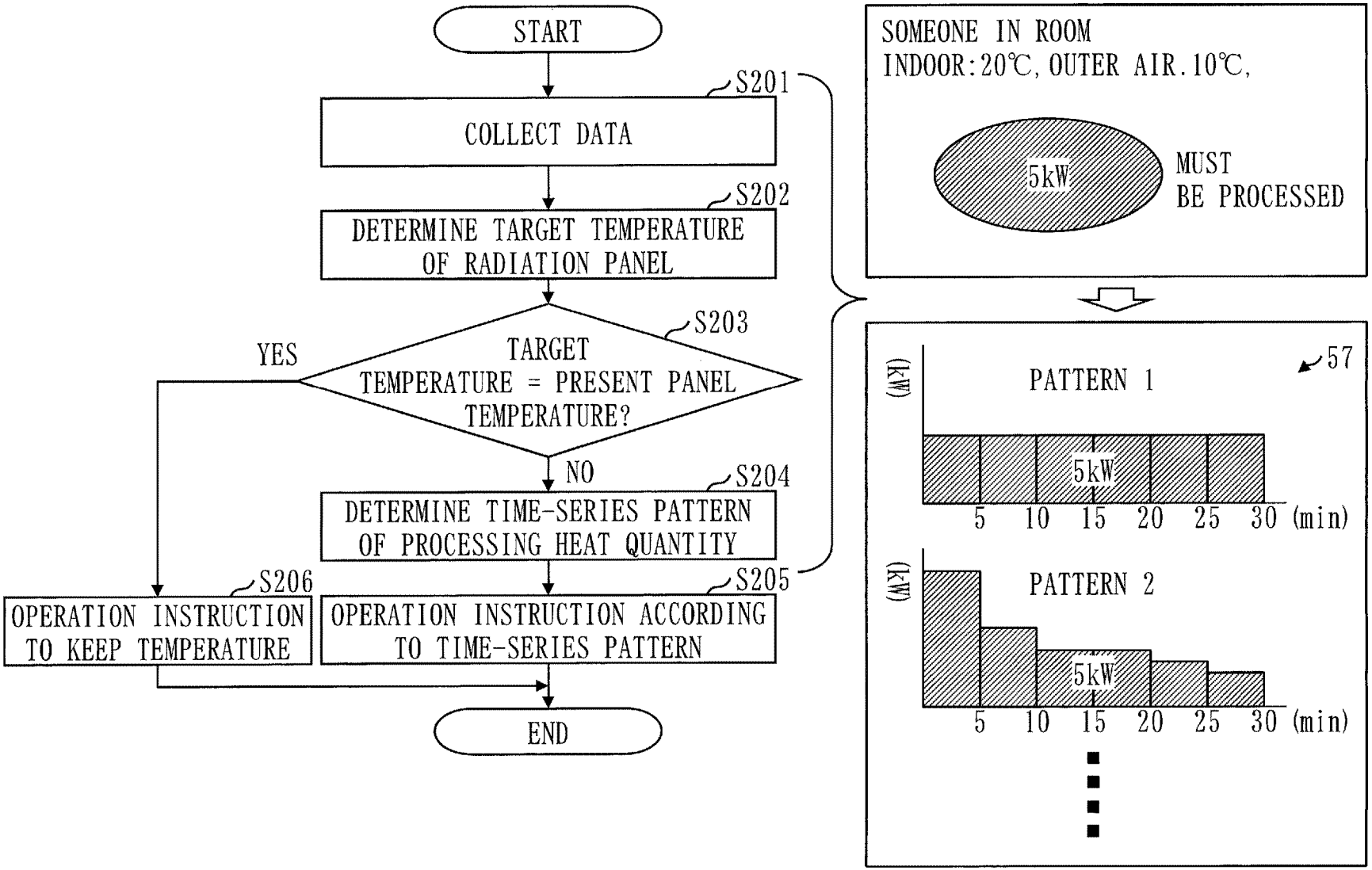
FIG. 5 is a flowchart illustrating behavior of the controller according to Embodiment 2.

The present embodiment will be described mainly regarding its difference from Embodiment 1 with referring to FIGS. 4 and 5.

*Description of Configuration*

A configuration of a controller 10 according to the present embodiment will be described with referring to FIG. 4.

In the present embodiment, the controller 10 is also connected to a human detector 34 by wired or wireless connection.

The human detector 34 is a sensor installed in indoor space to sense a human in the indoor space.

In the present embodiment, in-room presence data 58 to be described later is also stored in a memory 12 of the controller 10.

*Description of Behavior*

Behavior of the controller 10 according to the present embodiment will be described with referring to FIG. 5. The behavior of the controller 10 corresponds to a control method according to the present embodiment.

In step S201, a data collection unit 41 performs the same process as that of step S101 and collects the in-room presence data 58 from the human detector 34. The in-room presence data 58 is data indicating an in-room presence status of indoor space.

Specifically, in step S201, the data collection unit 41 receives the in-room presence data 58 from the human detector 34 using a communication device 13. The data collection unit 41 writes the received in-room presence data 58 to the memory 12.

Processes of step S202 and step S203 are the same as those of step S102 and step S103 and accordingly their description will be omitted.

In step S204, a heat quantity determination unit 42 adjusts a target time to be applied in accordance with the in-room presence status indicated by the in-room presence data 58.

Specifically, in step S204, when the in-room presence data 58 indicates that there is no one in the indoor space, the heat quantity determination unit 42 adjusts the target time to be applied to a time longer than a target time indicated by set data 56. The heat quantity determination unit 42 determines a time-series pattern 57 in accordance with the adjusted target time, target temperature of a radiation panel 21, temperature indicated by panel temperature data 53, and characteristics indicated by device characteristics data 55.

Processes of step S205 and step S206 are the same as those of step S105 and step S106 and accordingly their description will be omitted.

Description of Effect of Embodiment

In the present embodiment, the processing heat quantity can be determined with taking the in-room presence status into consideration.

Embodiment 3

Figure 6:
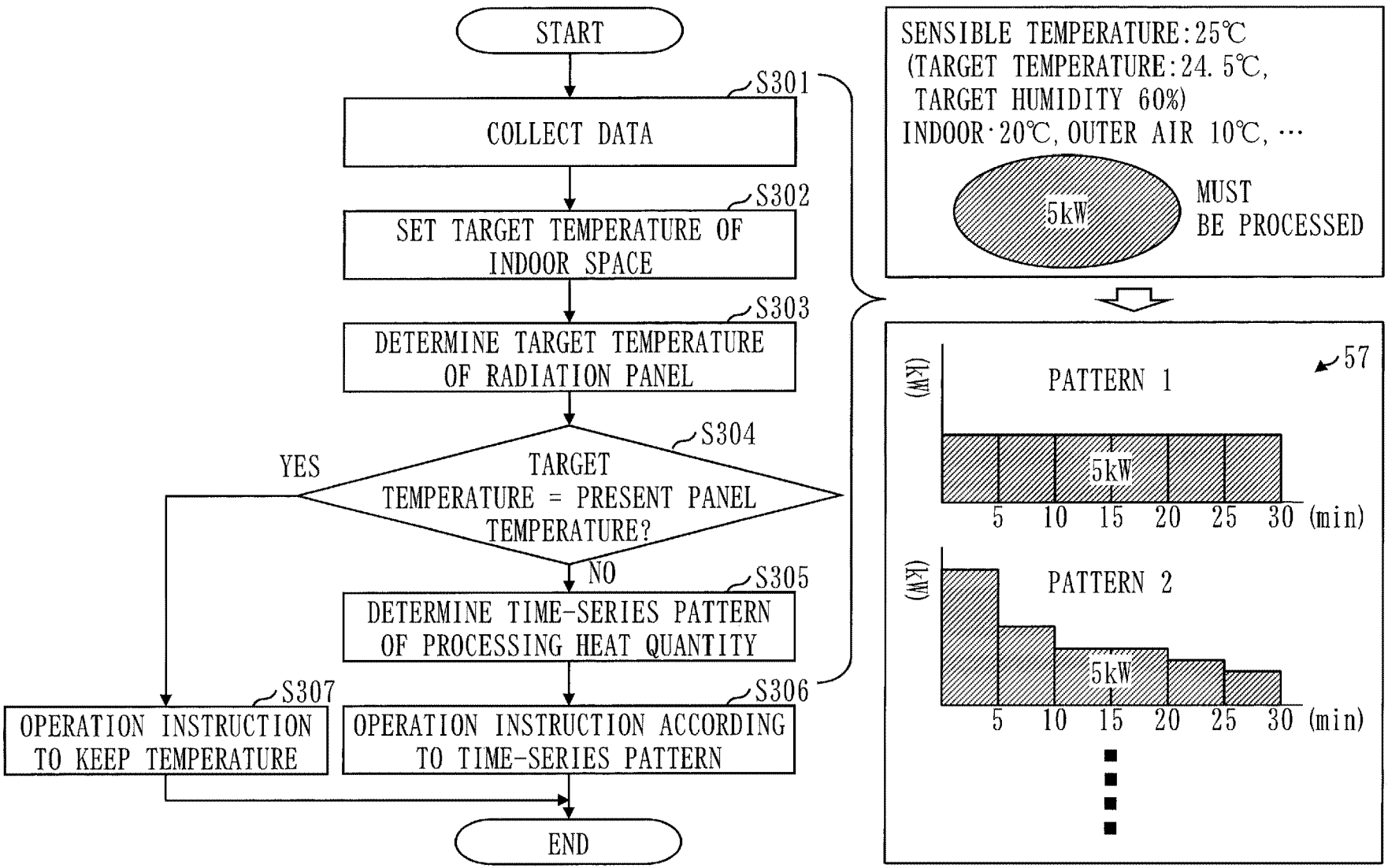
FIG. 6 is a flowchart illustrating behavior of a controller according to Embodiment 3.

The present embodiment will be described mainly regarding its difference from Embodiment 1 with referring to FIG. 6.

**Description of Configuration*

A configuration of a controller 10 according to the present embodiment is the same as that of Embodiment 1 illustrated in FIG. 1, and accordingly its description will be omitted. Note that in the present embodiment, an indoor environment measurement sensor 32 serves also as a sensor to measure humidity of indoor space.

*Description of Behavior*

Behavior of the controller 10 according to the present embodiment will be described with referring to FIG. 6. The behavior of the controller 10 corresponds to a control method according to the present embodiment.

In step S301, a data collection unit 41 performs the same process as that of step S101. Note that indoor environment data 52 includes data indicating the humidity of the indoor space. That is, the data collection unit 41 collects data indicating the humidity of the indoor space, as part of the indoor environment data 52, from the indoor environment measurement sensor 32.

The data collection unit 41 accepts setting of target sensible temperature via an input device 14. The data collection unit 41 writes data indicating the set sensible temperature to a memory 12 as part of set data 56. Instead of setting target sensible temperature by a user, data indicating sensible temperature may be stored in the memory 12 as part of the set data 56 before step S301.

In step S302, a heat quantity determination unit 42 reads the set data 56 from the memory 12. The heat quantity determination unit 42 sets target temperature of the indoor space and target humidity of the indoor space in accordance with the sensible temperature indicated by the set data 56. This target temperature substitutes for the target temperature indicated by the set data 56. Therefore, in the present embodiment, data indicating target temperature of the indoor space need not be included in the set data 56.

In step S303, the heat quantity determination unit 42 reads the indoor environment data 52 and panel characteristics data 54 from the memory 12. The heat quantity determination unit 42 determines target temperature of a radiation panel 21 in accordance with the target temperature and target humidity being set in step S302, temperature and humidity indicated by the indoor environment data 52, and characteristics indicated by panel characteristics data 54.

Processes of step S304 to step S307 are the same as those of step S103 to step S106 and accordingly their description will be omitted.

Description of Effect of Embodiment

In the present embodiment, processing based on the sensible temperature can be performed.

Embodiment 4

Figure 7:
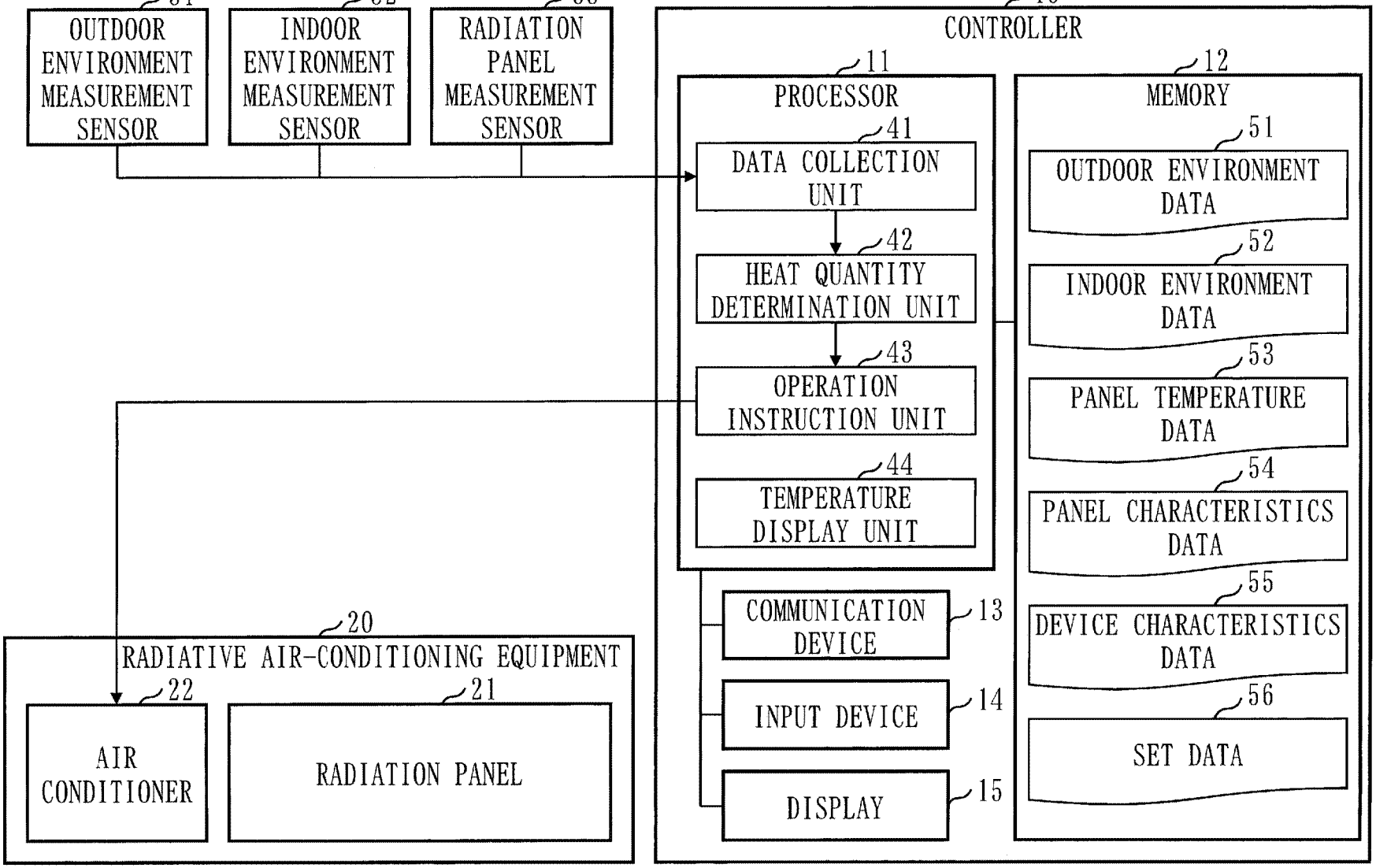
FIG. 7 is a block diagram illustrating a configuration of a controller according to Embodiment 4.
Figure 8:
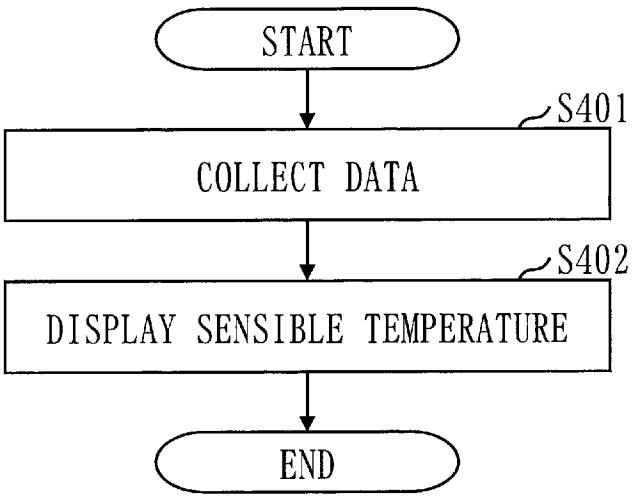
FIG. 8 is a flowchart illustrating behavior of the controller according to Embodiment 4.

The present embodiment will be described mainly regarding its difference from Embodiment 3 with referring to FIGS. 7 and 8.

*Description of Configuration*

A configuration of a controller 10 according to the present embodiment will be described with referring to FIG. 7.

In the present embodiment, the controller 10 is provided with a temperature display unit 44 as well as a data collection unit 41, a heat quantity determination unit 42, and a operation instruction unit 43, as function elements. Functions of the data collection unit 41, heat quantity determination unit 42, operation instruction unit 43, and temperature display unit 44 are implemented by software. That is, in the present embodiment, a control program is a program that implements the functions of the data collection unit 41, heat quantity determination unit 42, operation instruction unit 43, and temperature display unit 44.

*Description of Behavior*

Behavior of the controller 10 according to the present embodiment will be described with referring to FIG. 8. The behavior of the controller 10 corresponds to a control method according to the present embodiment.

A process of step S401 is the same as that of step S301 and accordingly its description will be omitted.

In step S402, the temperature display unit 44 reads indoor environment data 52 from a memory 12. The temperature display unit 44 calculates present sensible temperature from temperature and humidity which are indicated by the indoor environment data 52 and displays the calculated present sensible temperature.

Description of Effect of Embodiment

In the present embodiment, sensible temperature can be displayed.

*Other Configurations*

In the present embodiment, the functions of the data collection unit 41, heat quantity determination unit 42, operation instruction unit 43, and temperature display unit 44 are implemented by software, as in Embodiment 1. The functions of the data collection unit 41, heat quantity determination unit 42, operation instruction unit 43, and temperature display unit 44 may be implemented by hardware, as in the modification of Embodiment 1. Alternatively, the functions of the data collection unit 41, heat quantity determination unit 42, operation instruction unit 43, and temperature display unit 44 may be implemented by a combination of software and hardware.

Embodiment 5

Figure 9:
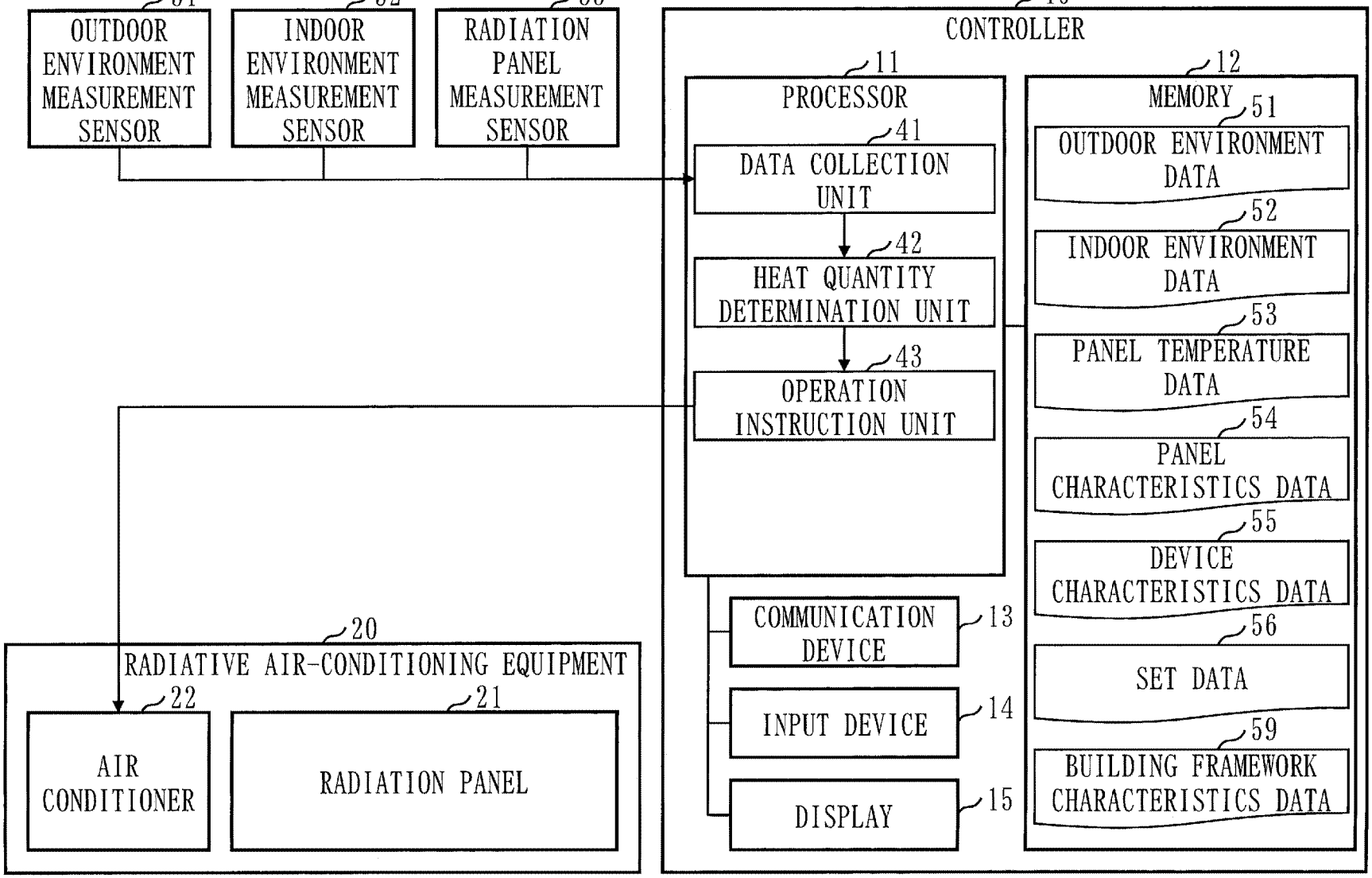
FIG. 9 is a block diagram illustrating a configuration of a controller according to Embodiment 5.
Figure 10:
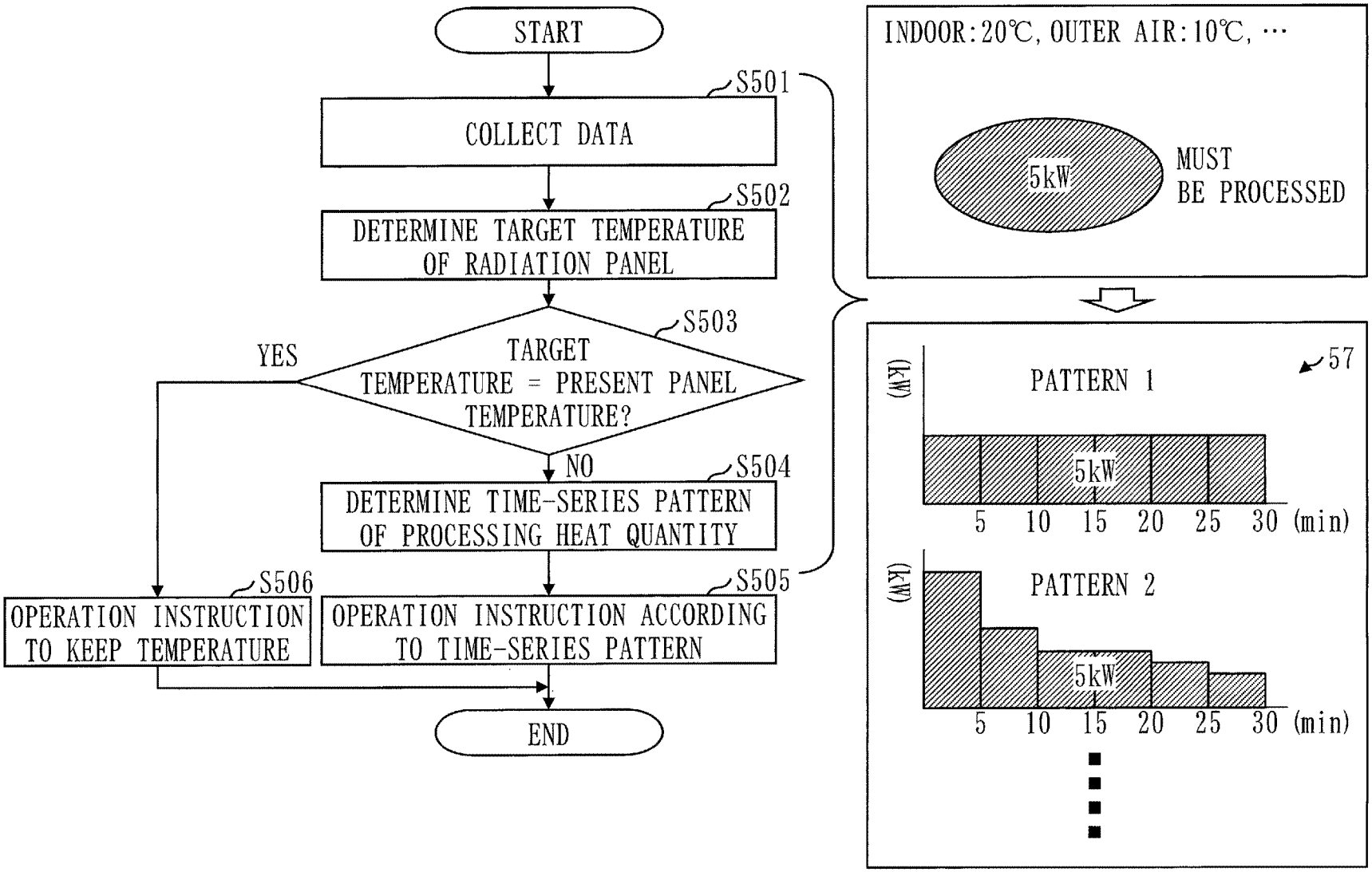
FIG. 10 is a flowchart illustrating behavior of the controller according to Embodiment 5.

The present embodiment will be described mainly regarding its difference from Embodiment 1 with referring to FIGS. 9 and 10.

*Description of Configuration*

A configuration of a controller 10 according to the present embodiment will be described with referring to FIG. 9.

In the present embodiment, building framework characteristics data 59 to be described later is also stored in a memory 12 of the controller 10.

*Description of Behavior*

Behavior of the controller 10 according to the present embodiment will be described with referring to FIG. 10. The behavior of the controller 10 corresponds to a control method according to the present embodiment.

A process of step S501 is the same as that of step S101 and accordingly its description will be omitted.

In step S502 to step S504, a heat quantity determination unit 42 further acquires the building framework characteristics data 59. The building framework characteristics data 59 is data indicating characteristics of a building framework that defines indoor space. The data indicating the characteristics of the building framework includes data indicating at least one of a window area, an outer-wall area, and heat insulation properties. The heat quantity determination unit 42 determines a time-series pattern 57 of a heat quantity to be processed by a radiative air-conditioning equipment 20, based on the acquired data and data which is collected by a data collection unit 41.

Specifically, in step S502, the heat quantity determination unit 42 reads the building framework characteristics data 59 as well as indoor environment data 52, panel characteristics data 54, and set data 56, from the memory 12. Assume that the building framework characteristics data 59 is stored in the memory 12 before step S501. The heat quantity determination unit 42 determines target temperature of a radiation panel 21 in accordance with target temperature indicated by the set data 56, temperature indicated by the indoor environment data 52, characteristics indicated by the panel characteristics data 54, and the characteristics indicated by the building framework characteristics data 59.

The user may input information concerning the characteristics of the building framework. In this case, the data collection unit 41 accepts input of the information concerning the characteristics of the building framework via an input device 14. The data collection unit 41 generates the building framework characteristics data 59 based on the inputted information. The data collection unit 41 writes the generated building framework characteristics data 59 to the memory 12. In step S502, the building framework characteristics data 59 is read by the heat quantity determination unit 42.

Processes of step S503 to step S506 are the same as those of step S103 to step S106 and accordingly their description will be omitted.

Description of Effect of Embodiment

In the present embodiment, building framework information can be inputted, and a processing heat quantity can be calculated with higher precision.

Embodiment 6

Figure 11:
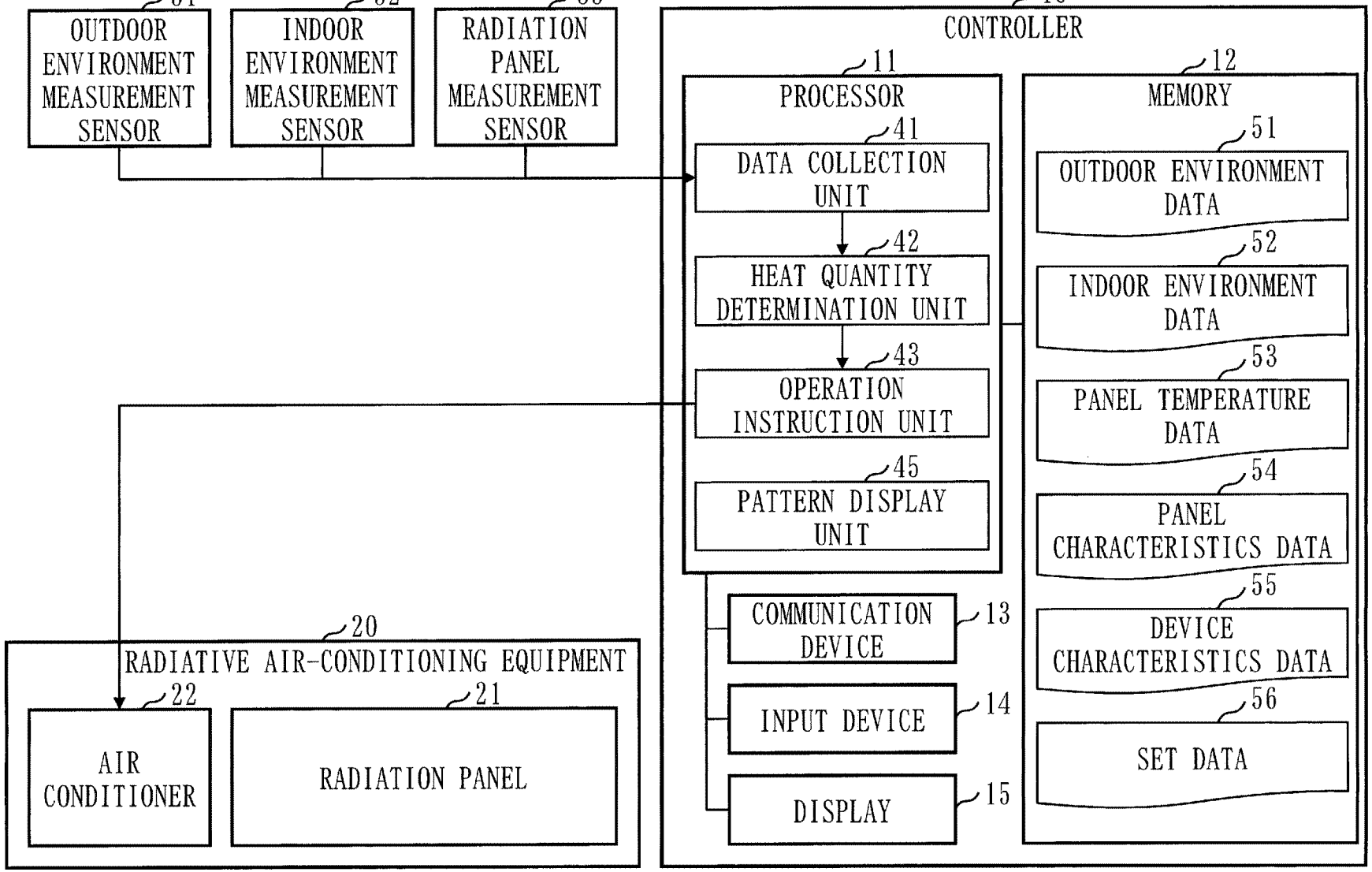
FIG. 11 is a block diagram illustrating a configuration of a controller according to Embodiment 6.
Figure 12:
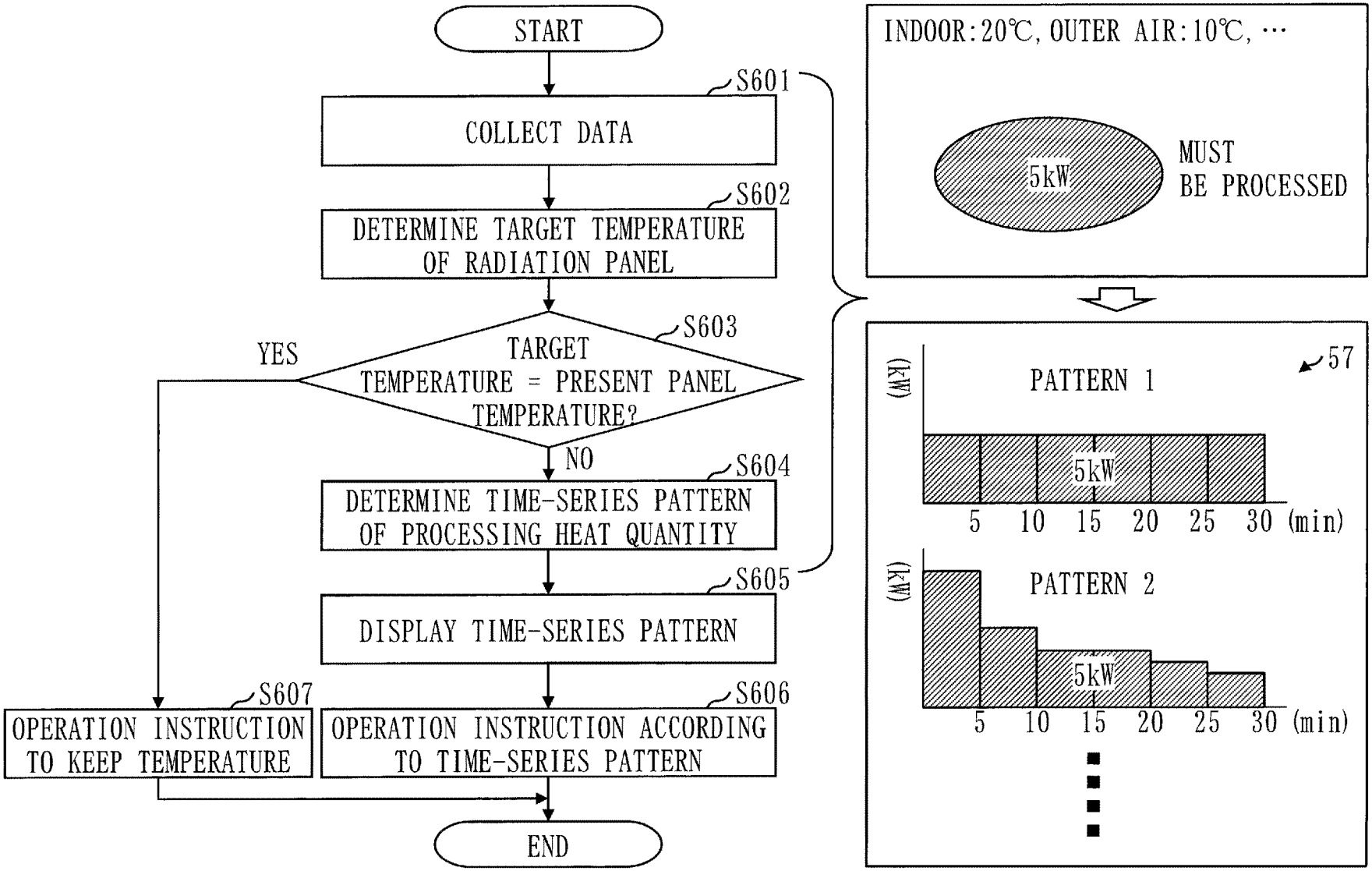
FIG. 12 is a flowchart illustrating behavior of the controller according to Embodiment 6.

The present embodiment will be described mainly regarding its difference from Embodiment 1 with referring to FIGS. 11 and 12.

*Description of Configuration*

A configuration of a controller 10 according to the present embodiment will be described with referring to FIG. 11.

In the present embodiment, the controller 10 is provided with a pattern display unit 45 as well as a data collection unit 41, a heat quantity determination unit 42, and a operation instruction unit 43, as function elements. Functions of the data collection unit 41, heat quantity determination unit 42, operation instruction unit 43, and pattern display unit 45 are implemented by software. That is, in the present embodiment, a control program is a program that implements the functions of the data collection unit 41, heat quantity determination unit 42, operation instruction unit 43, and pattern display unit 45.

*Description of Behavior*

Behavior of the controller 10 according to the present embodiment will be described with referring to FIG. 12. The behavior of the controller 10 corresponds to a control method according to the present embodiment.

Processes of step S601 to S604 are the same as those of step S101 to step S104 and accordingly their description will be omitted.

In step S605, the pattern display unit 45 displays a time-series pattern 57 determined by the heat quantity determination unit 42.

Specifically, in step S605, the pattern display unit 45 displays the time-series pattern 57 determined by the heat quantity determination unit 42, on a screen via a display 15.

Processes of step S606 and step S607 are the same as those of step S105 and step S016 and accordingly their description will be omitted.

In step S605, a pattern display unit 45 may display candidates such as pattern 1 and pattern 2 of the time-series pattern 57, and accepts an operation to select one candidate out of the displayed candidates. In this case, in step S606, the operation instruction unit 43 supplies an instruction to an air conditioner 22 for operating the air conditioner 22 according to the time-series pattern 57 selected by operating the pattern display unit 45.

Description of Effect of Embodiment

In the present embodiment, an operation plan of how to process heat can be presented to the user. In the operation plan, how to heat or cool a radiation panel 21, a wind velocity and wind direction of the air conditioner 22, and a schedule of the processing heat quantity may be described.

*Other Configurations*

According to the present embodiment, the functions of the data collection unit 41, heat quantity determination unit 42, operation instruction unit 43, and pattern display unit 45 are implemented by software, as in Embodiment 1. The functions of the data collection unit 41, heat quantity determination unit 42, operation instruction unit 43, and pattern display unit 45 may be implemented by hardware, as in the modification of Embodiment 1. Alternatively, the functions of the data collection unit 41, heat quantity determination unit 42, operation instruction unit 43, and pattern display unit 45 may be implemented by a combination of software and hardware.

Embodiment 7

Figure 13:
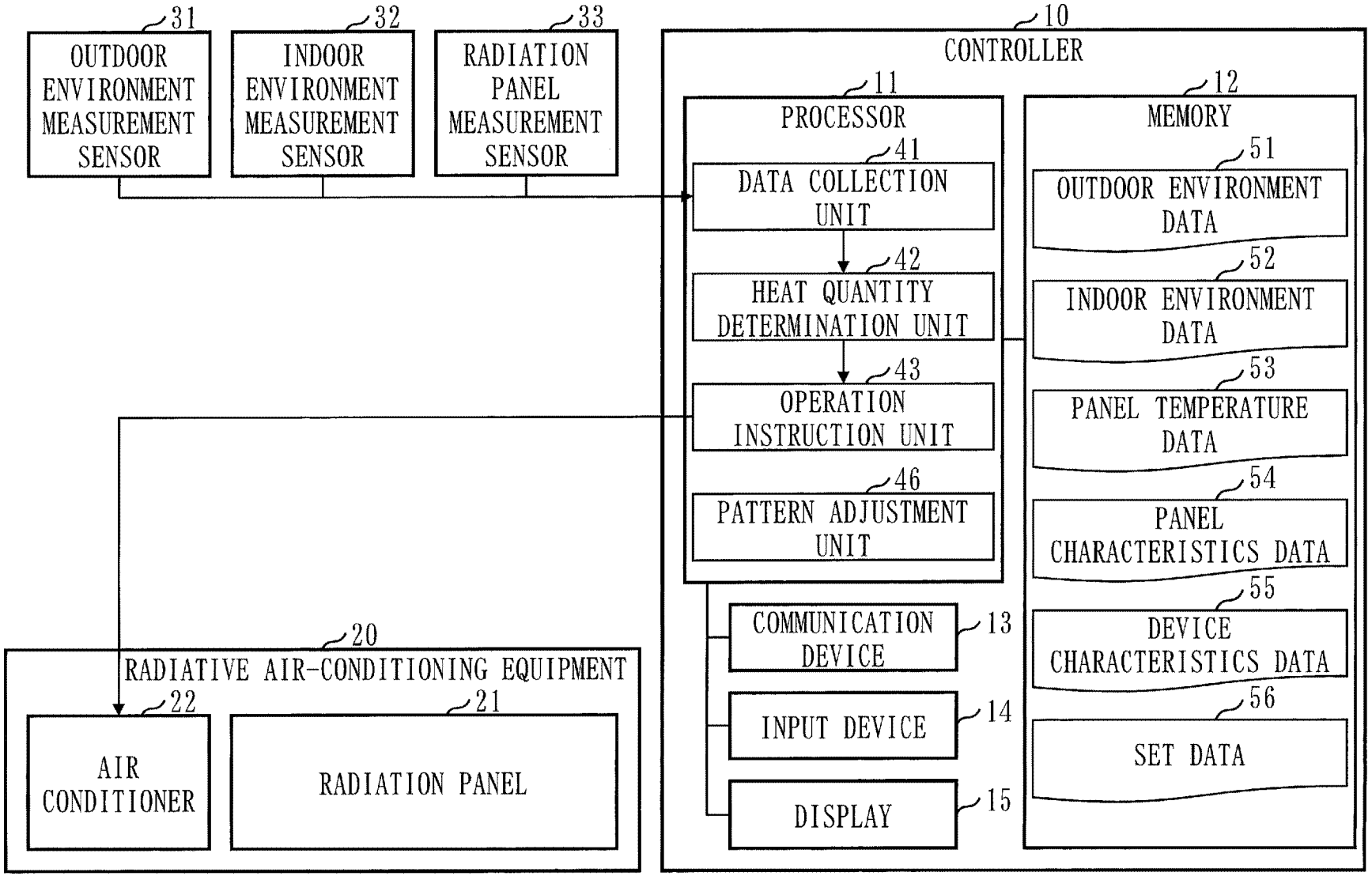
FIG. 13 is a block diagram illustrating a configuration of a controller according to Embodiment 7.
Figure 14:
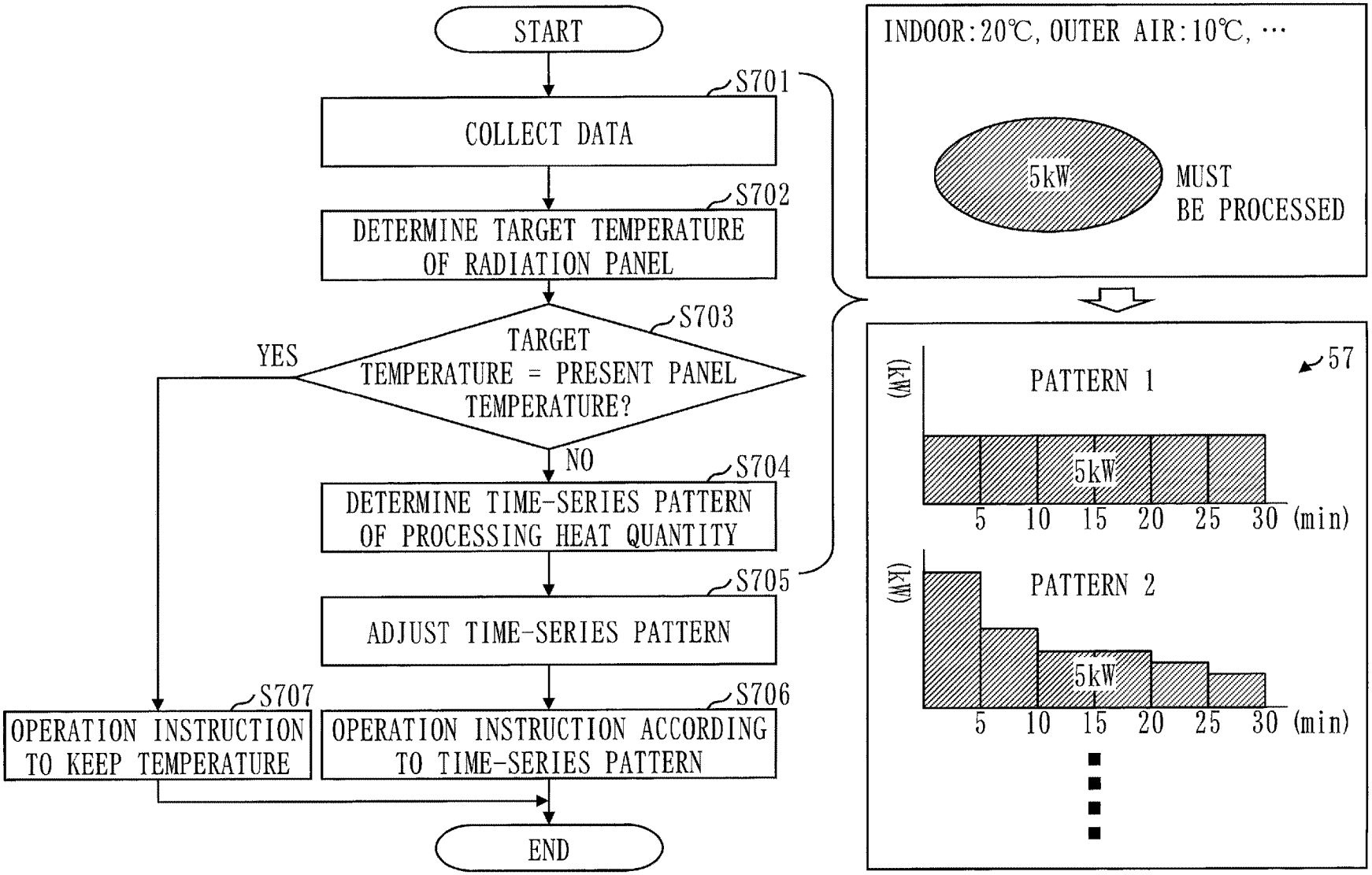
FIG. 14 is a flowchart illustrating behavior of the controller according to Embodiment 7.

The present embodiment will be described mainly regarding its difference from Embodiment 1 with referring to FIGS. 13 and 14.

*Description of Configuration*

A configuration of a controller 10 according to the present embodiment will be described with referring to FIG. 13.

In the present embodiment, the controller 10 is provided with a pattern adjustment unit 46 as well as a data collection unit 41, a heat quantity determination unit 42, and an operation instruction unit 43, as function elements. Functions of the data collection unit 41, heat quantity determination unit 42, operation instruction unit 43, and pattern adjustment unit 46 are implemented by software. That is, in the present embodiment, a control program is a program that implements the functions of the data collection unit 41, heat quantity determination unit 42, operation instruction unit 43, and pattern adjustment unit 46.

*Description of Behavior*

Behavior of the controller 10 according to the present embodiment will be described with referring to FIG. 14. The behavior of the controller 10 corresponds to a control method according to the present embodiment and accordingly its description will be omitted.

Processes of step S701 to step S704 are the same as those of step S101 to step S104 and accordingly their their description will be omitted.

In step S705, the pattern adjustment unit 46 accepts an operation of adjusting a time-series pattern 57 determined by the heat quantity determination unit 42.

Specifically, in step S705, the pattern adjustment unit 46 accepts an operation of adjusting the time-series pattern 57 via an input device 14.

In step S706, the operation instruction unit 43 gives to an air conditioner 22 an instruction for operating the air conditioner 22 according to the time-series pattern 57 adjusted by an operation of the pattern adjustment unit 46.

Specifically, in step S706, using a communication device 13, the operation instruction unit 43 transmits to the air conditioner 22 a signal that instructs an operation according to a processing heat quantity per unit time of the time-series pattern 57 adjusted by operating the pattern adjustment unit 46.

A process of step S707 is the same as that of step S106 and accordingly its description will be omitted.

Description of Effect of Embodiment

In the present embodiment, the user can modify an operation plan of how to process heat.

*Other Configuration*

In the present embodiment, the functions of the data collection unit 41, heat quantity determination unit 42, operation instruction unit 43, and pattern adjustment unit 46 are implemented by software, as in Embodiment 1. The functions of the data collection unit 41, heat quantity determination unit 42, operation instruction unit 43, and pattern adjustment unit 46 may be implemented by hardware, as in the modification of Embodiment 1. Alternatively, the functions of the data collection unit 41, heat quantity determination unit 42, operation instruction unit 43, and pattern adjustment unit 46 may be implemented by a combination of software and hardware.

Out of Embodiments 1 to 7, two or more embodiments can be combined. A control method of a different embodiment may be applied to each unit period such as a time window, season, year, month, day, and week.

REFERENCE SIGNS LIST

10: controller; 11: processor; 12: memory; 13: communication device; 14: input device; 15: display; 16: electronic circuit; 20: radiative air-conditioning equipment; 21: radiation panel; 22: air conditioner; 31: outdoor environment measurement sensor; 32: indoor environment measurement sensor; 33: radiation panel measurement sensor; 34: human detector; 41: data collection unit; 42: heat quantity determination unit; 43: operation instruction unit; 44: temperature display unit; 45: pattern display unit; 46: pattern adjustment unit; 51: outdoor environment data; 52: indoor environment data; 53: panel temperature data; 54: panel characteristics data; 55: device characteristics data; 56: set data; 57: time-series pattern; 58: in-room presence data; 59: building framework characteristics data.

The invention claimed is:

1. An air conditioner controller for controlling a radiative air-conditioning equipment which cools or heats space separated from indoor space by a radiation panel, with an air conditioner, so as to cool or heat the indoor space by a radiation effect of the radiation panel, the controller comprising:

processing circuitry configured to:

receive and collect, from a sensor that measures temperature of the indoor space, indoor environment data indicating temperature of the indoor space, receive and collect, from a sensor that measures temperature of the radiation panel, panel temperature data indicating temperature of the radiation panel, acquire panel characteristics data indicating characteristics of the radiation panel, acquire device characteristics data indicating characteristics of the air conditioner, determine a time-series pattern of a heat quantity to be processed by the air conditioner, based on the acquired panel characteristics data and device characteristics data and the collected indoor environment data and panel temperature data, generate and transmit, to the air conditioner, an instruction for operating at least one of a fan, a compressor, and a heat exchanger of the air conditioner based on the determined time-series pattern of the heat quantity, the instruction causing the at least one of the fan, the compressor, and the heat exchanger to cool or heat the space separated from the indoor space, and determine a target temperature of the radiation panel in accordance with:

a target temperature of the indoor space, the temperature indicated by the indoor environment data, and the characteristics indicated by the panel characteristics data, wherein to determine the time-series pattern includes:

calculating a sum of the heat quantity to be processed by the air conditioner based on a difference between the determined target temperature of the radiation panel and the temperature indicated by the panel temperature data, setting a plurality of candidates for the time-series pattern to match the calculated sum, calculating, for each candidate of the plurality of candidates, a coefficient of performance corresponding to the characteristics indicated by the device characteristics data, and choosing one candidate from the plurality of candidates based on the calculated coefficient of performance.

2. An air conditioner controller for controlling a radiative air-conditioning equipment which cools or heats space separated from indoor space by a radiation panel, with an air conditioner, so as to cool or heat the indoor space by a radiation effect of the radiation panel, the controller comprising:

processing circuitry configured to:

receive and collect, from a sensor that measures temperature of the indoor space, indoor environment data indicating temperature of the indoor space, receive and collect, from a sensor that measures temperature of the radiation panel, a panel temperature data indicating temperature of the radiation panel, acquire panel characteristics data indicating characteristics of the radiation panel, acquire device characteristics data indicating characteristics of the air conditioner, determine a time-series pattern of a heat quantity to be processed by the air conditioner, based on the acquired panel characteristics data and device characteristics data and the collected indoor environment data and panel temperature data, generate and transmit, to the air conditioner, an instruction for operating at least one of a fan, a compressor, and a heat exchanger of the air conditioner based on the determined time-series pattern of the heat quantity, the instruction causing the at least one of the fan, the compressor, and the heat exchanger to cool or heat the space separated from the indoor space, and determine a target temperature of the radiation panel in accordance with:

a target temperature of the indoor space, the temperature indicated by the indoor environment data, and the characteristics indicated by the panel characteristics data, wherein the determining of the time-series pattern utilizes:

a target time within which the temperature of the indoor space should reach the target temperature of the indoor space, the target temperature of the radiation panel, the temperature indicated by the panel temperature data, and the characteristics indicated by the device characteristics data.

3. The air conditioner controller according to claim 2, wherein the processing circuitry is further configured to:

collect in-room presence data indicating an in-room presence status of the indoor space from a sensor that senses a human in the indoor space, and adjust the target time in accordance with the in-room presence status indicated by, the in-room presence data.

4. The air conditioner controller according to claim 1, wherein the processing circuitry is further configured to:

collect data indicating humidity of the indoor space, as part of the indoor environment data, from a sensor that measures humidity of the indoor space, and set the target temperature of the indoor space and target humidity of the indoor space in accordance with a target sensible temperature, and determine the target temperature of the radiation panel in accordance with:

the set target temperature of the indoor space and the set target humidity of the indoor space, the temperature and humidity that are indicated by the indoor environment data, and the characteristics indicated by the panel characteristics data.

5. The air conditioner controller according to claim 4, wherein the processing circuitry is further configured to calculate a present sensible temperature from the temperature and the humidity which are indicated by the indoor environment data, and displays the calculated present sensible temperature.

6. The air conditioner controller according to claim 1, wherein the processing circuitry is further configured to acquire building framework characteristics data indicating characteristics of a building framework that defines the indoor space, and to determine the time-series pattern based on the acquired data and the collected data.

7. The air conditioner controller according to claim 1, wherein the processing circuitry is configured to cause display of the determined time-series pattern.

8. The air conditioner controller according to claim 1, wherein the processing circuitry is further configured to:

accept an operation of adjusting the determined time-series pattern, and generate and transmit, to the air conditioner, an instruction for operating at least one of the fan the compressor, and the heat exchanger of the air conditioner based on the adjusted time-series pattern.

9. The air conditioner controller according to claim 1, wherein the panel characteristics data includes data indicating characteristics of an opening which is formed in the radiation panel for supplying air to the indoor space from space cooled or heated by the air conditioner.

10. The air conditioner controller according to claim 9, wherein the data indicating the characteristics of the opening is data indicating an opening area of the opening.

11. The air conditioner controller according to claim 1, wherein the panel characteristics data includes data indicating an area of a radiation surface of the radiation panel.

12. The air conditioner controller according to claim 1, wherein the panel characteristics data includes data indicating an emissivity of the radiation panel.

13. The air conditioner controller according to claim 1, wherein the device characteristics data includes data indicating characteristics of at least any one of a compressor, a heat exchanger, and a fan of the air conditioner.

14. A radiative air-conditioning equipment mounted with the air conditioner controller according to claim 1.

15. A control method of controlling a radiative air-conditioning equipment which cools or heats space separated from indoor space by a radiation panel, with an air conditioner, so as to cool or heat the indoor space by a radiation effect of the radiation panel, the control method comprising:

collecting, from a sensor that measures temperature of the indoor space, indoor environment data indicating the temperature of the indoor space;

collecting, from a sensor that measures temperature of the radiation panel, panel temperature data indicating the temperature of the radiation panel;

acquiring panel characteristics data indicating characteristics of the radiation panel;

acquiring device characteristics data indicating characteristics of the air conditioned;

determining a time-series pattern of a heat quantity to be processed by the air conditioner, based on the acquired panel characteristics data, the acquired device characteristic data, the collected indoor environment data, and the collected panel temperature data;

generating and transmitting, to the air conditioner, an instruction for operating at least one of a fan, a compressor, and a heat exchanger of the air conditioner based on the determined time-series pattern of the heat quantity, the instruction causing the at least one of the fan, the compressor, and the heat exchanger to cool or heat the space separated from the indoor space; and determining a target temperature of the radiation panel in accordance with:

a target temperature of the indoor space, the temperature indicated by the indoor environment data, and the characteristics indicated by the panel characteristics data;

wherein the determining of the time-series pattern includes:

calculating a sum of the heat quantity to be processed by the air conditioner based on a difference between the determined target temperature of the radiation panel and the temperature indicated by the panel temperature data, setting a plurality of candidates for the time-series pattern to match the calculated sum, calculating, for each candidate of the plurality of candidates, a coefficient of performance corresponding to the characteristics indicated by the device characteristics data, and choosing one candidate from the plurality of candidates based on the calculated coefficient of performance.

16. An air conditioner controller for controlling a radiative air-conditioning equipment which cools or heats space separated from indoor space by a radiation panel, with an air conditioner, so as to cool or heat the indoor space by a radiation effect of the radiation panel, the controller comprising:

circuitry including:

a first input configured to receive, from a sensor that measures temperature of the indoor space, indoor environment data indicating temperature of the indoor space;

a first memory configured to collect instances of the indoor environment data;

a second input configured to receive, from a sensor that measures temperature of the radiation panel, panel temperature data indicating temperature of the radiation panel;

a second memory configured to collect instances of the pane temperature data;

a third memory configured to accessibly store panel characteristics data indicating characteristics of the radiation panel;

a fourth memory configured to accessibly store device characteristics data indicating characteristics of the air conditioner;

a processor configured to determine a time-series pattern of a heat quantity to be processed by the air conditioner, based on the panel characteristics data, the device characteristics data, the collected indoor environment data, and the collected panel temperature data, and to generate an operation instruction for operation of at least one of a fan, a compressor, and a heat exchanger of the air conditioner based on the determined time-series pattern; and an output configured to transmit to the air conditioner the operation instruction, the operation instruction causing the at least one of the fan, the compressor, and the heat exchanger of the air conditioner to cool or heat the space separated from the indoor space, wherein the processor is further configured to determine a target temperature of the radiation panel in accordance with:

a target temperature of the indoor space, the temperature indicated by the indoor environment data, and the characteristics indicated by the panel characteristics data; and the processor configuration to determine the time-series pattern includes configuration to:

calculate a sum of the heat quantity to be processed by the air conditioner based on a difference between the determined target temperature of the radiation panel and the temperature indicated by the panel temperature data, set a plurality of candidates for the time-series pattern to match the calculated sum, calculate, for each candidate of the plurality of candidates, a coefficient of performance corresponding to the characteristics indicated by the device characteristics data, and choose one candidate from the plurality of candidates based on the calculated coefficient of performance.

* * * * *